US005868404A

United States Patent [19]

Montague

[11] Patent Number: 5,868,404

[45] Date of Patent: Feb. 9, 1999

[54] ROLLER SKATE BRAKING SYSTEM

[76] Inventor: David G. Montague, 9 Estabrook Rd., Newton, Mass. 02165

[21] Appl. No.: 683,434

[22] Filed: Jul. 19, 1996

[51] Int. Cl.[6] ..... A63C 17/14

[52] U.S. Cl. ..... 280/11.2; 280/11.22

[58] Field of Search ..... 280/11.19, 11.2, 280/11.22, 11.23, 11.27, 11.28, 87.041, 87.042; 180/165

[56] References Cited

U.S. PATENT DOCUMENTS

| | | |
|---|---|---|
| 5,320,367 | 6/1994 | Landis . |
| 5,340,131 | 8/1994 | Smathers et al. . |
| 5,411,276 | 5/1995 | Moldenhauer . |
| 5,415,419 | 5/1995 | Bourque . |

*Primary Examiner*—Richard M. Camby
*Attorney, Agent, or Firm*—Sughrue, Mion, Zinn, Macpeak & Seas, PLLC

[57] ABSTRACT

The braking system for one or both of the skates such as in-line skates. The braking system uses a hand held RF transmitter activated by a switch to initiate braking action by a receiver located on the skate. The brake, once actuated, can work directly off the ground and be a friction pad type device on the skate and when activated it drags on the ground or a two-fold friction device composed of a extra back wheel that can be restrained by a pad braking device before it is then lowered to having a restricted roll friction on the ground. The braking device can work directly onto the rolling wheels with a friction pad or again it can be a twofold friction device composed of a small convex braking wheel above the rolling wheels that is slowed by a friction pad device before it is used then to restrict the rolling wheels. The remote radio signal device generates the radio signal which is tied to the braking function of the skate to provide either continuous force or a variable braking force. The system also uses wheel rotation and terrain incline data as an input sent by RF signal to said hand held unit to generate skater data such as distance travelled, speed and the like.

10 Claims, 10 Drawing Sheets

ROLLER SKATE BRAKING SYSTEM

BACKGROUND OF THE INVENTION

1. Field of the Invention

This invention relates to roller skates such as in-line skates and particularly to a braking system and an information retrieval system using RF signals linking a hand held unit to a braking located on the skate.

2. Prior Art

In-line skating has become a popular sport but one of the more difficult aspects of this type of skating is braking and speed control, for example when descending a hill. Various roller skate brakes have been developed to aid the skater in braking and speed control but suffer from a number of deficiencies. The two general types currently in use depend on friction being applied directly to the ground with a dragging surface or friction applied to the rolling wheel or wheels, like car and bicycle brakes. The dragging surface method can involve lifting the toe of the skate which often proves to be difficult for beginners or novices.

Another system involves cuff rotation is described in U.S. Pat. No. 5,415,419 where the top portion of the boot rotates backward activating the dropping of a dragging surface to the ground or braking of the rolling wheels. The activation of this technique for this braking means involves placing one or both legs in distorted positions with the front foot extending far forward during braking. While this method is easier than the dragging frictional method, it is nonetheless difficult for beginners or novices. In addition, this method involves building a multi-part hinged boot which is more complicated, more expensive, and does not provide the rigidity desired by skaters. The systems which are the easiest to activate are the hand control activated braking systems. U.S. Pat. Nos. 5,439,238; 5,340,131 and 5,411,276 are representative of such systems. These devices generally use a hand held or belt held lever device that activates a wire, cable or fluid line which is connected to a brake on the skate which can be a pad which directly contacts the ground or some type of friction braking applied to the rolling wheels. U.S. Pat. No. 5,439,238 uses a cable running from the skates to the hand of the skater which when activated causes a dragging pad to be dropped to the ground. U.S. Pat. No. 5,411,276 uses friction applied to the rolling wheels.

These systems, although they are easier for novices and beginners to learn to use, are not ideal for a number of reasons. These brake controls inhibit the motion of the skaters hands, arms and legs by restricting them with a cable which runs down the arm area, back to their belt area, and then down their legs to the skates. In addition, any cables strung on the arms, torso, and legs can be dangerous if it were to catch on a passing protrusion such as bench, fire plug or tree. Due to the extreme movement involved in skating, cables also tend to rub and cause discomfort on the skaters skin.

U.S. Pat. No. 5,439,238 discloses a bicycle type squeeze lever which can be stored in the waist belt area while not being used. While this systems allows the motion of the arms to be uninhibited, it results in slower braking reaction times as the skater must quickly reach and attempt to locate the control.

SUMMARY OF THE INVENTION

A radio controlled system overcomes these problems by not having a wire which inhibits the motion of the arms of the skater and by having controls located in the hand, on the back of the hand, or the wrist in a known location where they can be instantly located and activated when braking is needed. Finally with the wireless radio controls attached to the hand or wrist by a band secured by a simple catch or VELCRO™ strip, the device can easily be installed or removed. As more and more people use skating as a means of exercise as well as transportation, demand is increasing for information about a skating trip. Currently there are no skating systems that provide a transfer of information (such as distance travelled, speed, average speed, cadence, terrain incline, calories burned, etc.) from the skater to the rider. This information would be highly valuable to the skater who is skating as a form of exercise or transportation. This information can also be used as data for a small computer which can calculate and automatically limit top speed of the skate—a safety feature which would prove to be beneficial for many skaters.

The present invention is thus directed to a roller skate overcoming functional limitations of prior roller skate brakes, and skate data systems. The present invention provides the simplest and safest to use system of braking without the present control encumbrances. The system has two essential sub-systems, first is a battery powered hand held device that transmits an RF braking signal and receives speed etc. as an informational signal. This device can also be powered by solar-recharged batteries, or a system which translates the extreme hand motion experienced during skating into electricity. The second sub-system is the device located on the skates which receives the RF braking signal and converts it into skate braking action and also transmits the radio signal containing speed, etc. data. This skate located system may be powered by a skate mounted battery which could re-charge using solar energy, use a motion-generator, a skate mounted generator driven by rotation of the wheels or by a kinetic energy brake driver.

While not limited to any one system, any one or more of the following three braking systems could be used. The simplest braking system would have an on-off function with only one switch and no variation on braking power. It may also use a skid block for braking. The intermediary systems could permit the adjustment of the braking pressure to allow the rider to slow down more quickly if needed by holding the switch in the on position gradually increasing the braking pressure or by applying more pressure to the switch or lever itself. In the sophisticated cabled controlled braking system of U.S. Pat. No. 5,411,276, one applies varying degrees of pressure on the bicycle type lever, held in ones hand, which, down in the skate, puts pressure on a friction pad touching a braking wheel, which in turn rubs against the rolling wheel, producing uniform, variable braking. The radio signal control system of this invention would achieve the same results in a cable-free manner.

Finally, the most complex systems in accordance with this invention have multiple choices including the ability to set a drag brake, or the ability to set a computer controlled response system which automatically limits top speed, or considers terrain grade in brake settings.

The information retrieval of this invention employs information in a similar manner to a bicycle trip computer and then sends this information by RF signal to the hand held device which displays a readout of speed, average speed, cadence, terrain incline, calories burned, etc. The same hand device then has both brake control and information readout incorporated in a single unit. If desired, the device can use either hand control to skate braking without the information readout. Likewise, in accordance with this invention a conventional braking system could be used and have only the skate to hand: information readout without hand activated braking. The systems can be separated.

Finally, in order to conserve energy and limit the size of the battery required in the skate, a braking system which translates kinetic energy from the skaters momentum into energy used to drive the brakes pads onto the wheels or drive a pad directly onto the ground can be employed. An example of an energy saving system useable in this invention is a ratchet brake system in which the ratchet is moved into contact with either the passing ground or a spinning wheel by RF signal. Once in contact with the ground or wheel, it would be caused to ratchet tighter by spinning and therefore causing a cable to be tightened. This cable could then be attached to a braking system which would slow or stop the skater. In a similar manner, a generator of electricity could be used in a manner where it could be moved into contact with a wheel when the brakes were applied or at another time controlled by the skater. It would then re-charge the battery each time the brakes were applied or when the skater activated it. In this manner, kinetic energy which would normally be lost during braking to heating up the wheels, pads, or ground, would now be partially translated into electrical energy which would re-charge the battery. Therefore, the size of the battery required would be smaller than if this or a similar system were not used.

This invention will be described in greater detail with reference to the drawing and the description of the preferred embodiment that follows.

BRIEF DESCRIPTION OF THE DRAWING

In order that the invention may be more clearly understood, the preferred embodiment thereof will now be described in detail by way of example, with reference to the accompanying drawings, in which.

DETAILED DESCRIPTION OF THE PREFERRED EMBODIMENTS

Figure 1:
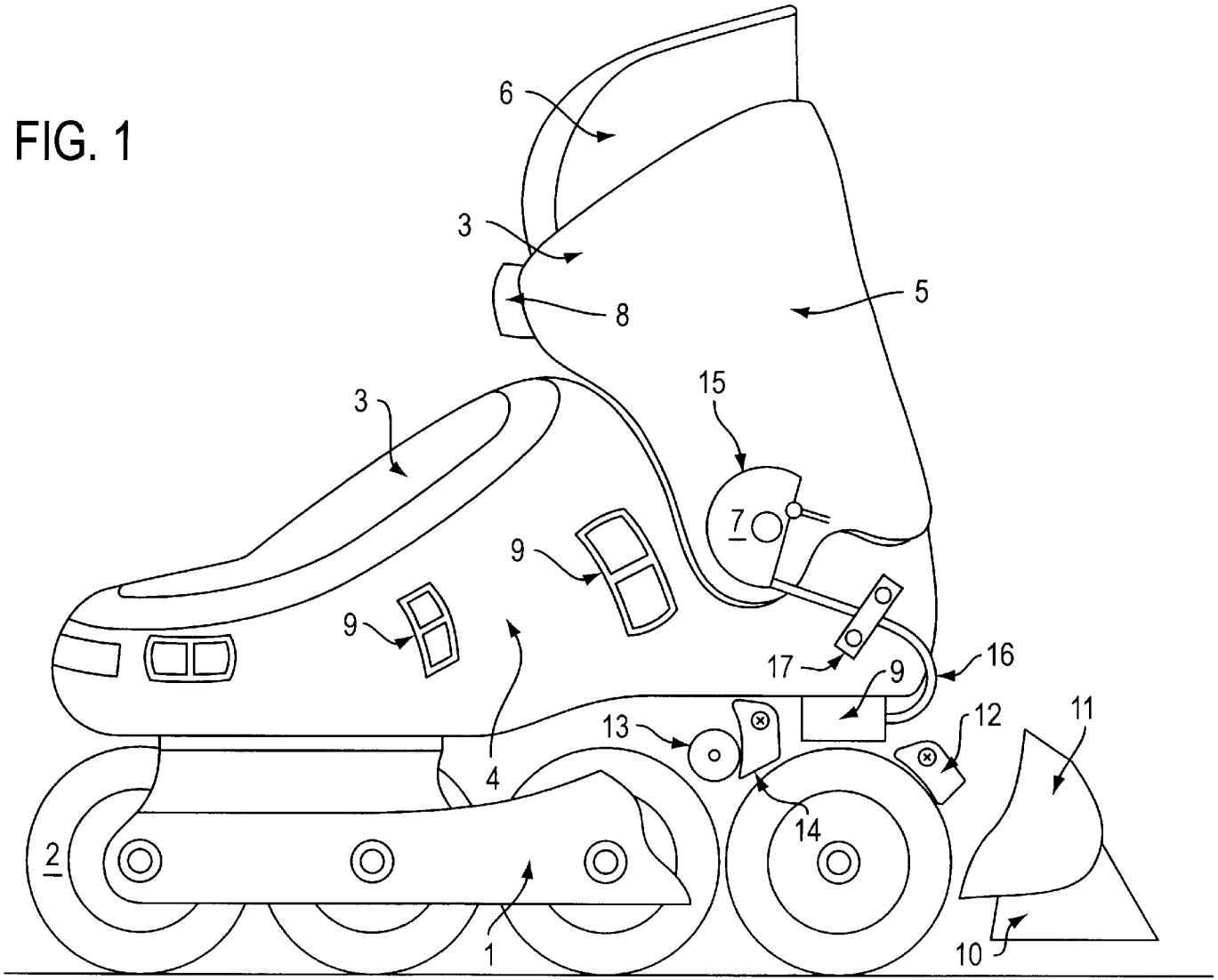
FIG. 1 is a side view of a typical in-line skate.

Referring to FIG. 1, the main components of the skate are a chassis 1 which carries wheels 2, a boot 3 having a lower boot section 4 and an upper cuff section 5. The liner 6 is conventional stiffness and fits within the entire boot 3. The cuff section 5 can be pivotally connected or not depending on if the cuff movement is a part of the braking process. The pivotal point 7 of the cuff is shown and the cuff has standard cuff straps 8 and the lower section 4 has a standard strap 9. The above items are standard for in-line skate construction.

There are various skate braking system that can be used with this basic in-line skate configuration. Four embodiments are described and illustrated but the invention is not in anyway meant to limit other possibilities, not illustrated but within the scope of this invention. The simplest configuration is a standard heal pad 10 that can be fixed and is used by lifting the front of the boot and dragging it on the ground. It would be desirable to include a fixed pad like this with all the other radio signal control systems so that if for some reason the wireless system failed to operated this brake pad would always be present as a back up system.

In a different format, this pad can be leveraged or pivoted down to the ground, for example held by a moveable chassis 11 by controls without lifting the front of the boot. In addition to having a dragging pad such as this, FIG. 1 illustrates that the back rolling wheel can be fictionally slowed to produce more even braking than can be achieved with the use of the dragging pad. The friction slowing process of this wheel can be done by squeezing caliper brakes or by a standard pad 12 which the controls can lower onto the wheel or by two or more rolling wheels that could also be braked directly with 12 type blocks. If this system provides braking that is too abrupt, a small braking wheel 13 can be used along with a braking block 14, providing a two part braking system. This braking system can also be expanded to brake two or more of the rolling wheels. Any of these techniques or combination thereof can be used in the braking process. Not illustrated but useable are any of the systems which require the lifting of the front tow. These, however, are not as desirable as the above mentioned methods, where the skate stays flat on the ground for more controlled braking.

All of the above mentioned braking means are controlled from a motion initiator 9. This box houses a solenoid that either produces the braking motion directly or moves a ratchet into position which then provides braking power using the skaters kinetic energy. Also, the motion initiator 9 uses a battery that powers the motor and a radio receiver and transmitter which communicate with the hand device. The battery could be separately located, for example on the sole of the skate conformal in shape as a part of the skate body 4. The battery is typically a NiMH type capable of quick recharging without memory effect.

Referring now to FIGS. 2, 3, 4 and 5, embodiments of the hand-held unit are depicted. Different types of hand or wrist held radio brake activation and information devices can be used as braking controls and/or information systems for skates. Four preferred embodiments are illustrated. Braking can be wrist activated, thumb activated or finger activated. In each case by the application of pressure or movement, a signal is generated by the hand-held unit and transmitted to apply a braking force. Various pressure or force transducers can be used as inputs to the RF circuit for transmission to the receiver at the wheels.

As shown in FIGS. 2–5 there are a number of components that are common to all hand or wrist held radio signal device. First, it is desirable, but not mandatory, that they have some sort of strap which secures them to the hand or wrist as shown as a wide band 20, in FIG. 2, a wrist strap 21 in FIG. 3, and across the back of the hand a strap 22 in FIG. 4. In each of these cases the band 20 or wrist strap 21 is preferably a portion of a skaters wrist guards. That is , it is currently common for in-line skaters to wear wrist guards as a protective measure and these components are worn on each hand and have rigid inserts to protect the hand and wrist in case of a fall. Consequently, the trigger, display and battery components can easily be incorporated into those guards without severely increasing their bulk or size.

Figure 2:
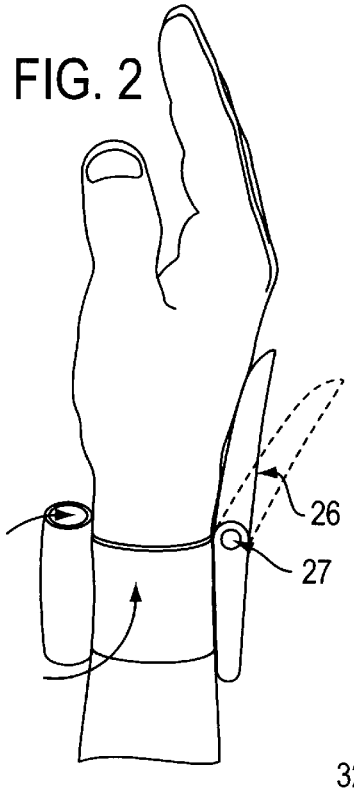
FIGS. 2, 3, 4, and 5 are side views of hand located control devices in accordance with different embodiments of this invention.
Figure 3:
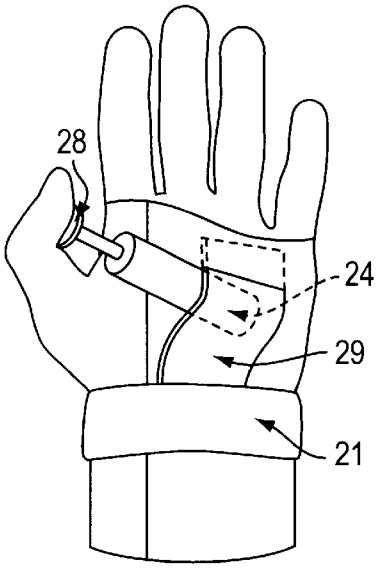
Figure 4:
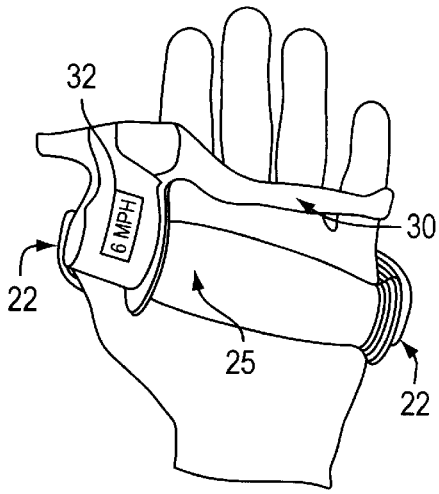

The hand-held unit in each embodiment must have a small battery along with the radio transmitter/receiver, as shown in FIG. 2 in a housing 23, FIG. 3 as an external flap 24, and in FIG. 4 as a hand grip 25 to contain a source of power. The battery can be non-rechargeable, or can be rechargeable using a plug in system, a solar re-charging system with a few solar cells mounted on the exterior, or a movement driven electrical generating system. An antenna, not shown will be present. It could be incorporated into the strap or otherwise located in a non-obstructive position.

FIG. 2 shows the wrist activated device which activates the brakes when the wrist is bent backwards past the straight arm and hand position. This system is shown with a pad 26 being pressed against the back of the hand and pushed into the dotted position. When the hand moves forward with relation to the arm a spring 27 returns the braking to the off position. The advantages of the wrist activated controls are that they free up the inside of the hands to hold objects, grab onto objects, and break falls if they occur. Information on speed, distance and the like may be displayed on pad 26 or another location. This information would be picked off of a wheel as a function of rate of rotation. Obviously, the translation of wheel rotational rates into speed and distance readings are known in other applications such as bicycles. The control of the wrist movement however, is not as precise as that of thumb and finger controls.

FIG. 3 illustrates a thumb activated plunger 28 which, when depressed, activates the radio signal. The plunger is connected to the control box and is shown secured to the wrist strap with flexible strip 29. The backward motion of the thumb as with the wrist could be used in lieu of the plunger shown.

FIG. 4 shows a bicycle brake type configuration which is used with other cable connected hand to skate controls. In this case, however, the device can be strapped to the hand and removed easily. The squeezing of the fingers of the hand against the lever 30, squeezing the lever against the housing 25 which activates the braking system.

Figure 5:
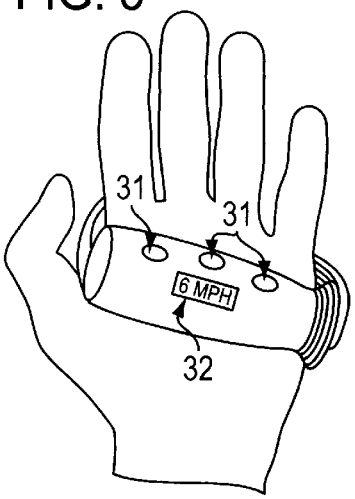
Figure 6A:
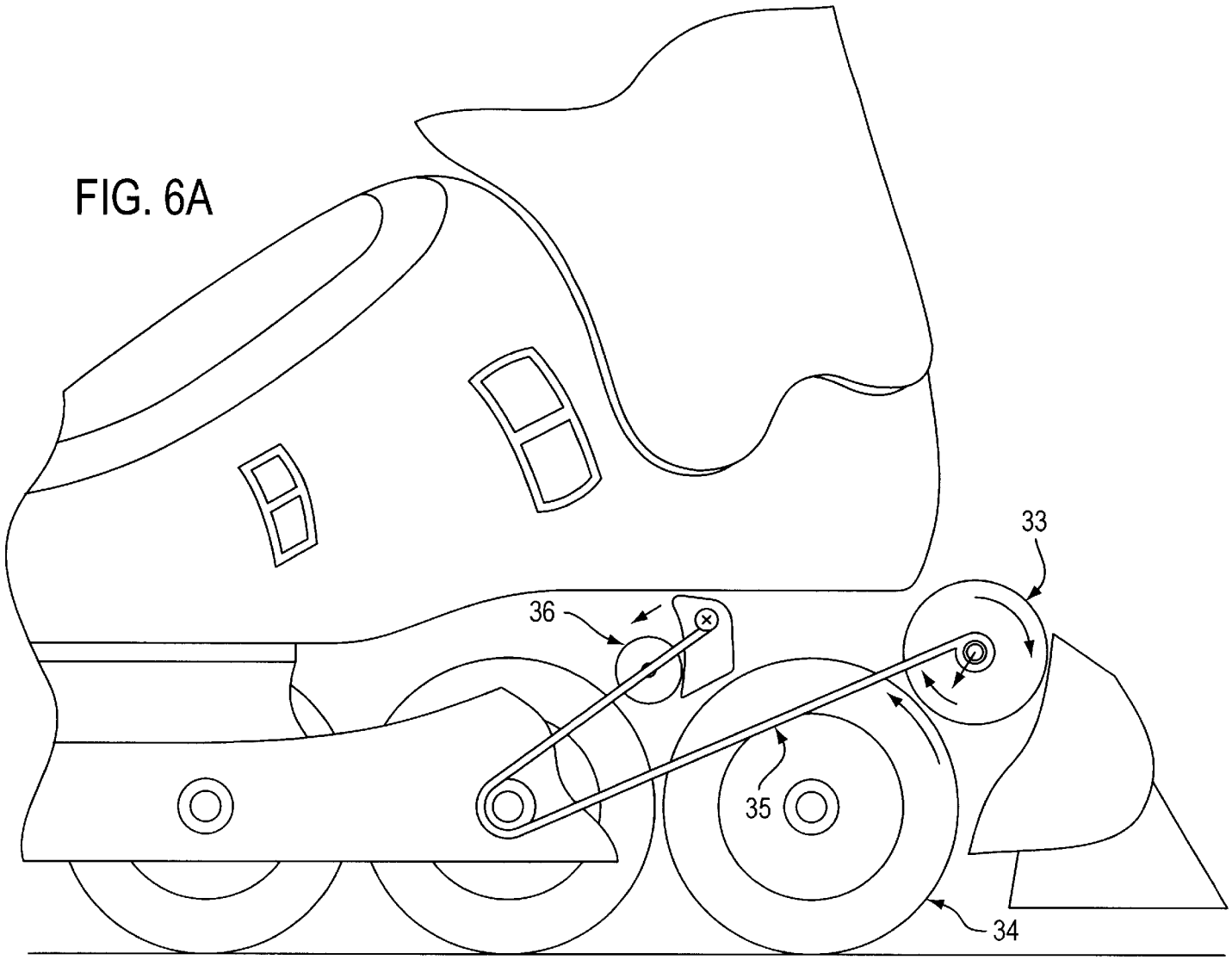
FIGS. 6A–6G are side views of different embodiments of an energy saving skate braking system.
Figure 6B:
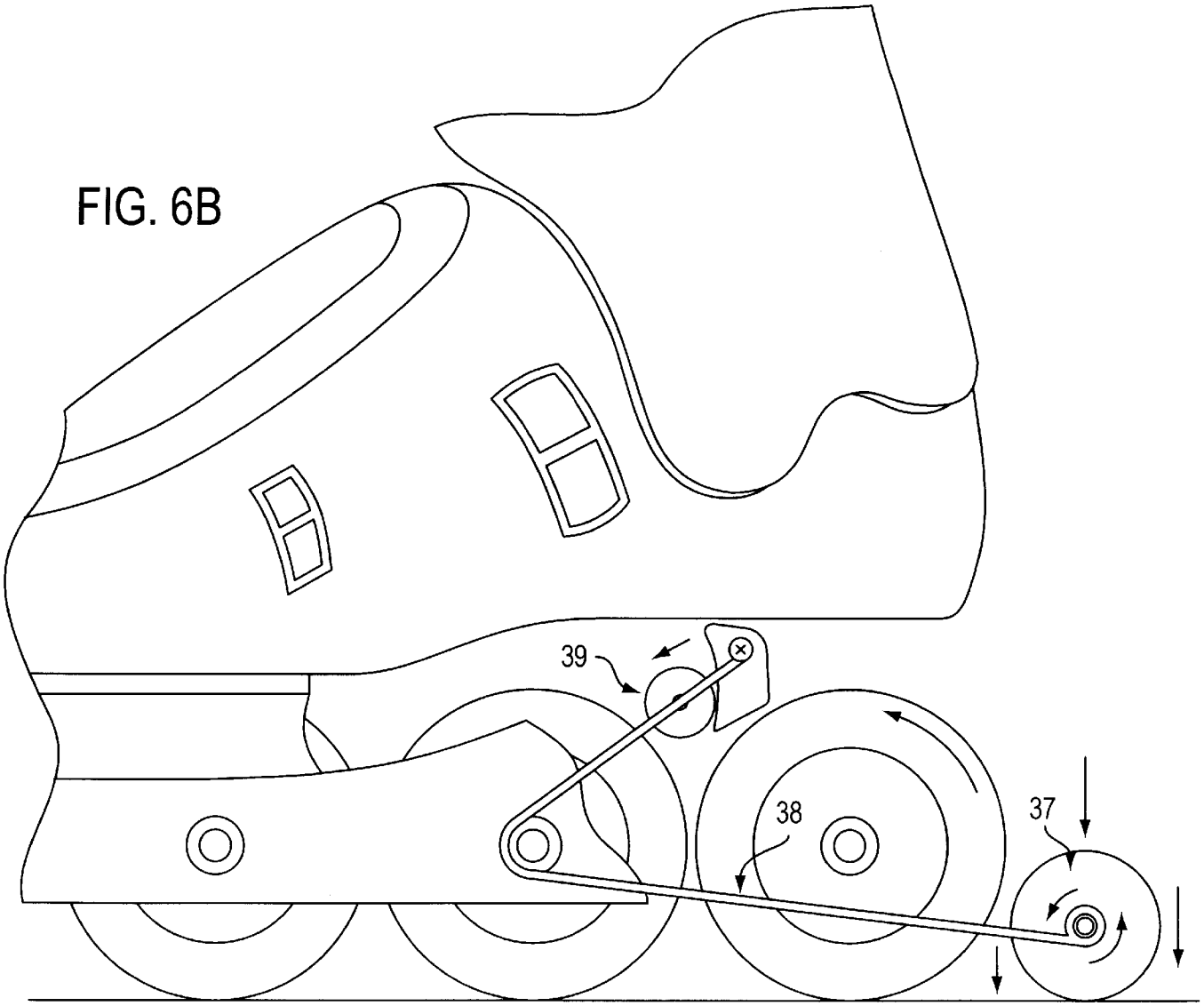
Figure 6C:
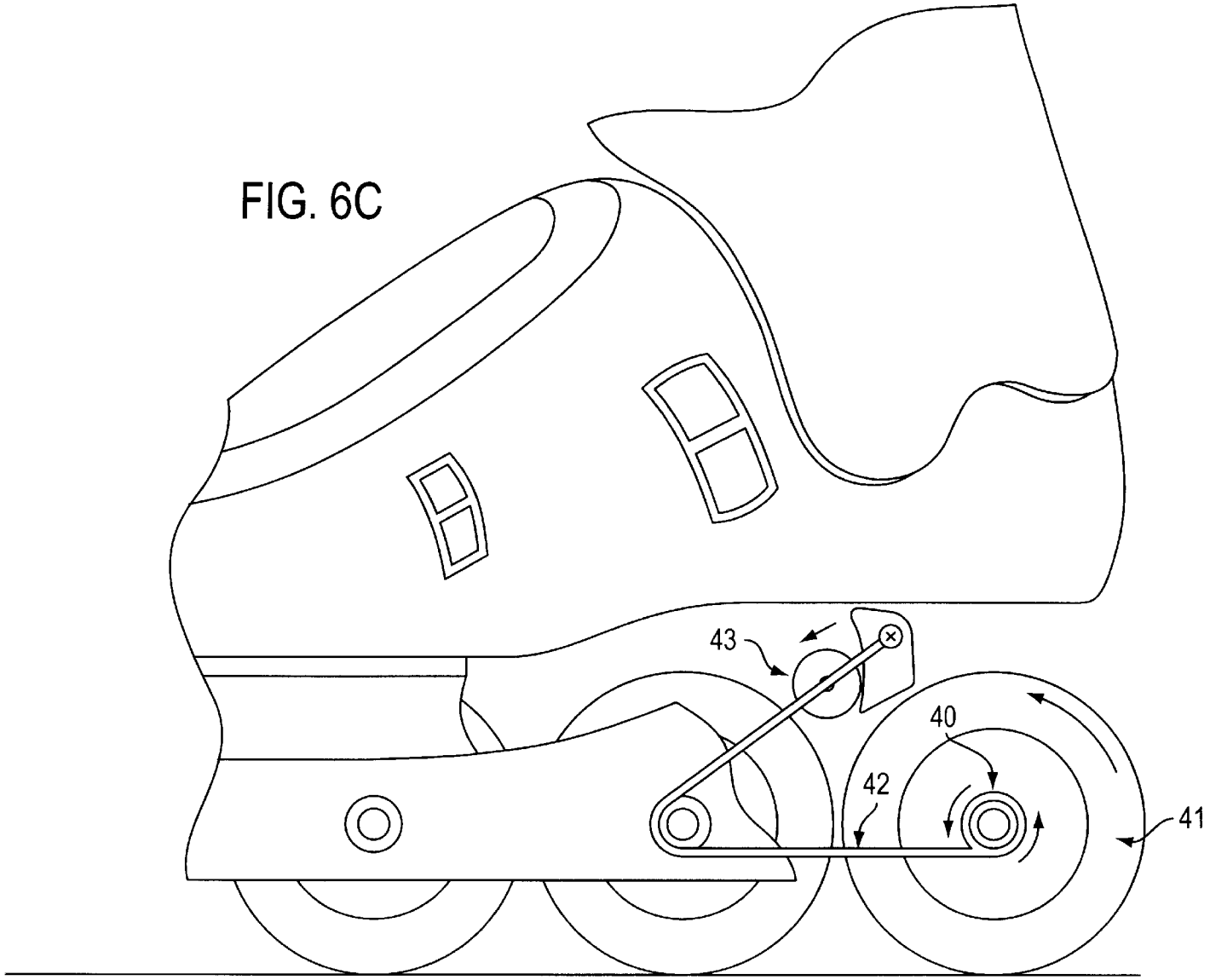
Figure 6D:
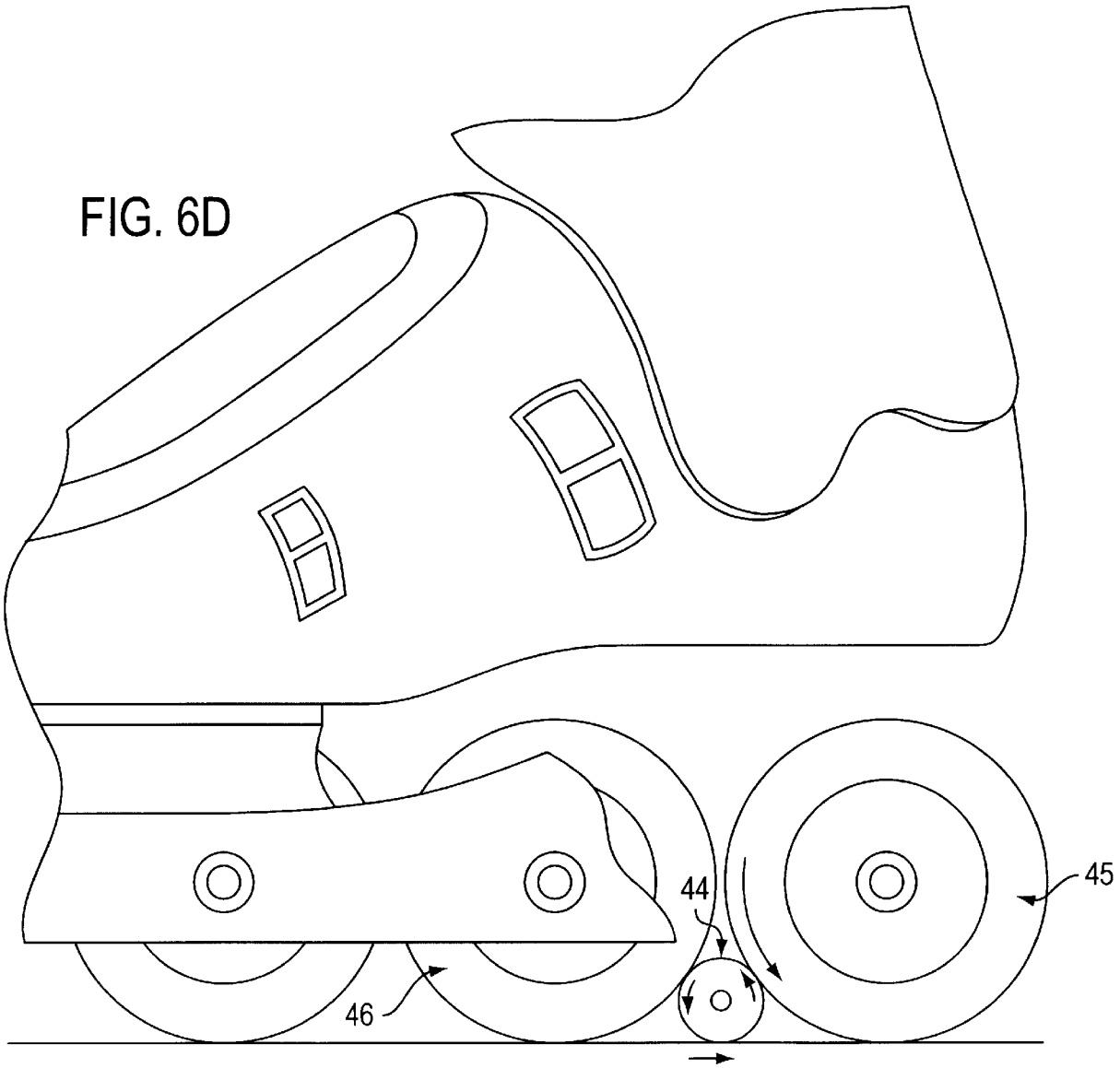
Figure 6E:
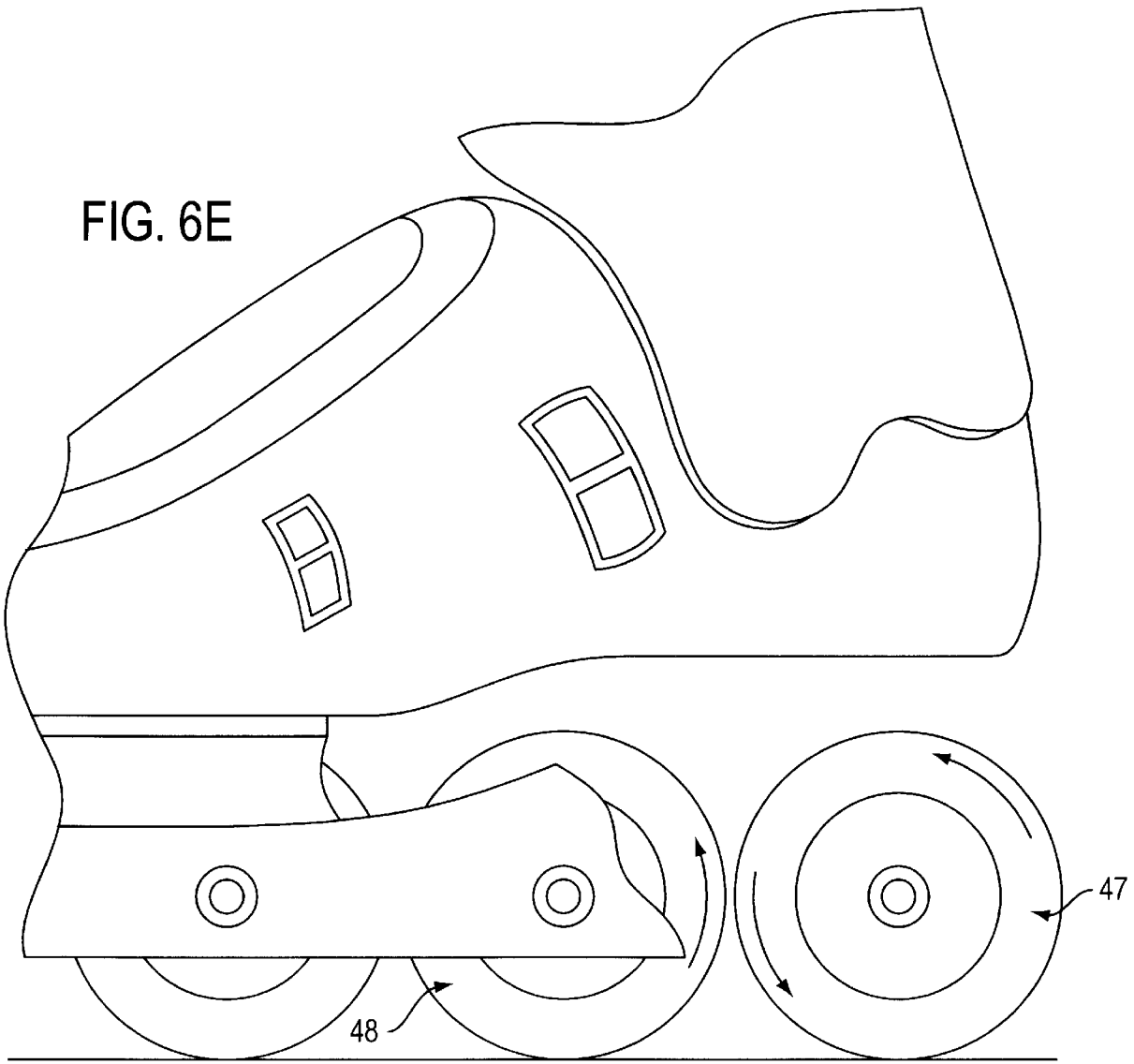
Figure 6F:
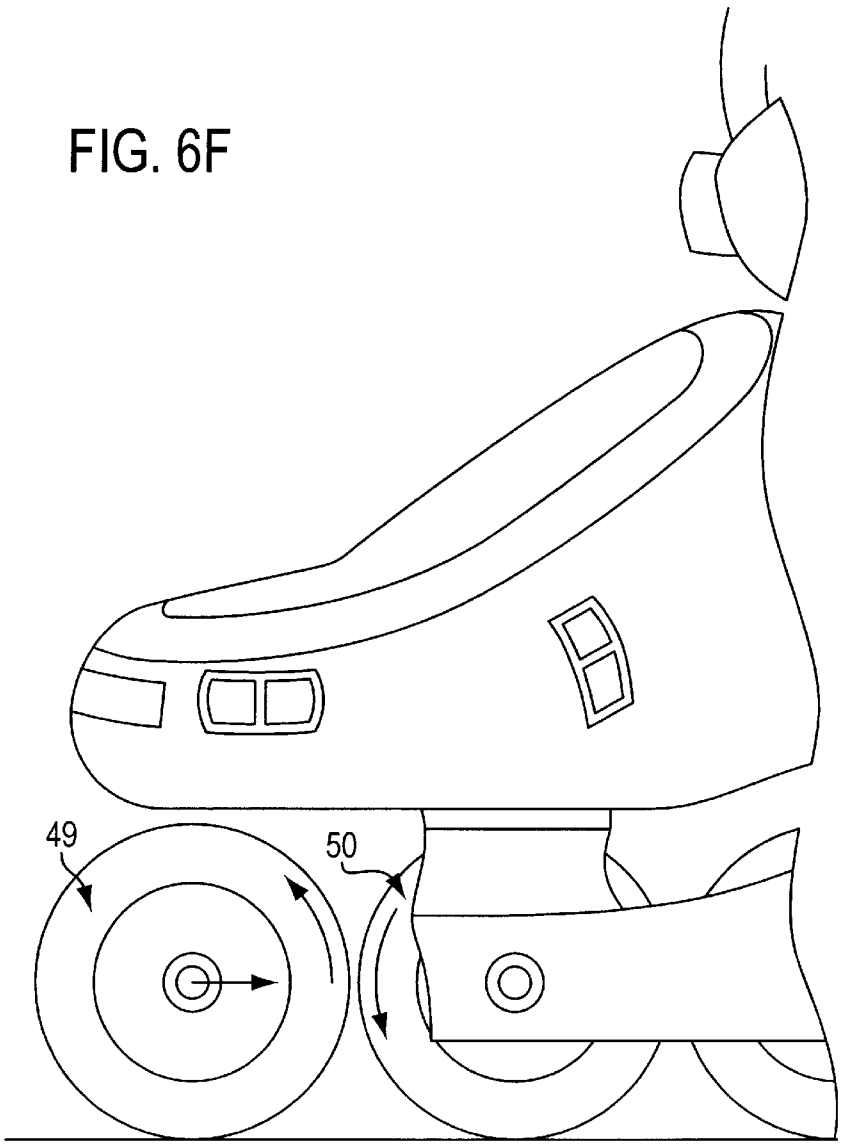
Figure 6G:
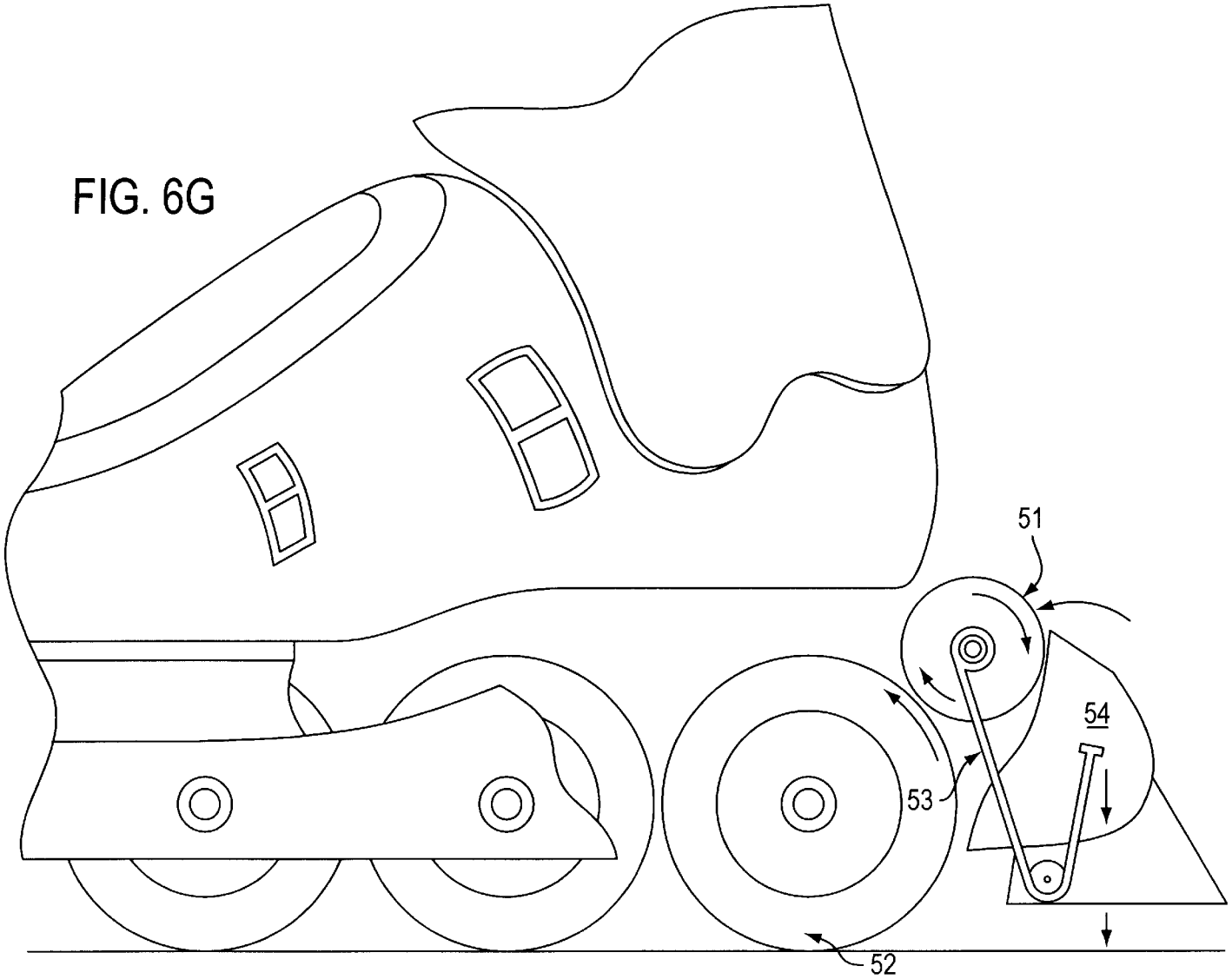

FIG. 5 illustrates a button controlled device which is operated by pushing or holding in one or more buttons 31 in order to activate brakes. Information readout is illustrated as display 32. In FIGS. 4 and 5 the display is illustrated as being located on the palm side of the device. If incorporated into wrist guards, the display could easily be embedded into the solid protective material and placed on the outside of the guard near the wrist where viewing would be directly analogous to a watch.

FIG. 6 illustrates variations of the Kinetic Energy Brake Driver. In one embodiment—FIG. 6A, ratchet, spring, or friction system 33 is moved into contact with wheel 34 by RF signal. Ratchet 33 then tightens causing tension in cable 35. Cable 35 then pulls brake 36 into contact with another wheel or wheels or skid pad. This system can be used to drive any of the brakes discussed. FIG. 6B shows a ratchet, spring, friction, or similar wheel 37 which is moved into contact with the ground by RF signal. It is connected to a belt 38 which tightens causing brake 39 to engage on a wheel or wheels or skid pad. Further, FIG. 6C shows ratchet, spring or friction system 40 which is mounted on the axle of wheel 41. Ratchet, spring, or friction system 40 is engaged to wheel 41 by RF signal causing belt 42 to tighten, causing brake 43 to move into contact with one or more wheels or skid pad. FIG. 6D shows a Kinetic Energy Brake Driver which uses a small ratchet, spring or friction system 44 which is moved into contact with the ground by RF signal. Wheel 44 then spins causing a direct braking force to be applied on one or more wheels 45 and 46. This demonstrates how a Kinetic Energy Brake Driver can be belt-free. FIG. 6E shows another alternative embodiment which is belt-free. In this figure, wheel 47 is moved by RF signal to come into contact with wheel 48 causing braking forces to be applied. FIG. 6F shows this same system applied to a different wheel 49 which is moved by RF signal to contact wheel 50 and cause a braking motion. Both FIG. 6E and 6F could also be caused to activate by any other means other than RF signal as well. FIG. 6G shows a ratchet, spring, or friction wheel 51 which is caused by RF signal to come into contact with wheel 52 causing belt 53 to tighten and thereby causing skid brake 54 to contact the ground. Any combination of the above whether directly driving, using a ratchet system, spring system, friction system can be married with any braking system using the kinetic energy from the skaters momentum to drive a braking system.

Figure 7:
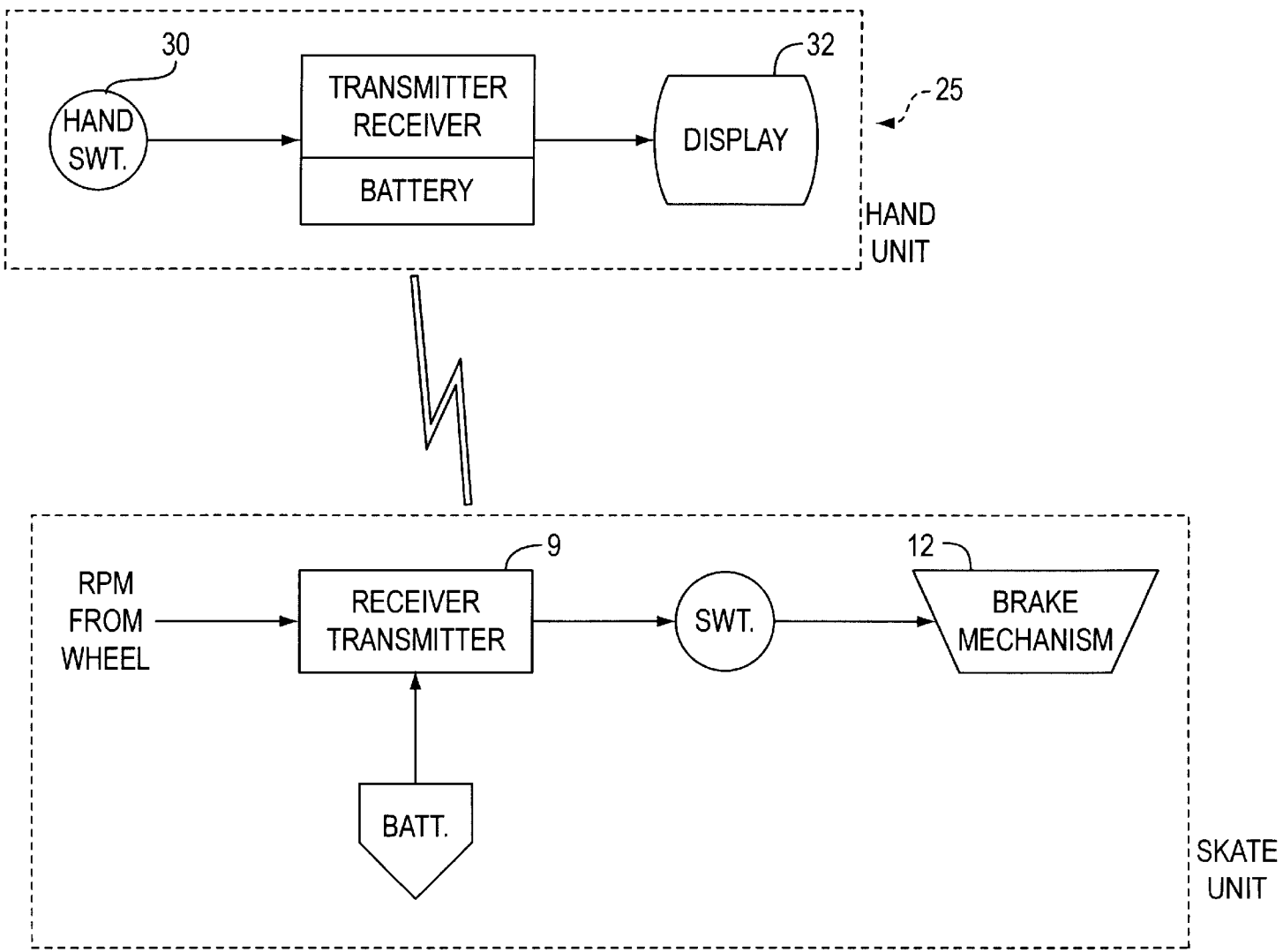
FIG. 7 is a block diagram of the schematic elements of this system.

Referring to FIG. 7 the basic system elements are depicted. For purposes of illustration the numbering for the hand held unit follows that of FIG. 4. The hand unit comprises the operating switch 30 to initiate braking action, the RF transmitter/receiver and battery in housing 25 together with display 32. It will be apparent to those of working skill that the display may be a low power LCD system powered either by the battery or use solar cells.

The RF link "RF" is illustrated schematically to the skate unit. The receiver/transmitter is contained in housing 9. Rotational information from any wheel is delivered as an input and sent back to the hand held unit for signal processing and display. It will be readily apparent that with RPM data, distance, speed and the like can easily be calculated. While not illustrated, it is apparent that a chip similar to that found in bicycles or exercise devises can convert rotational data into, speed, distance, acceleration and the like. Other data such as incline of the terrain can also be measured at the skate using the skate body or in-line wheel carriage as a baseline level and delivering that data to the hand-held unit for display. The receiver portion receives a signal indicating that braking action should occur and delivers an output to an electromechanical transducer, i.e a switch to initiate braking action of the brake mechanism 12. As indicated herein, the receiver/transmitter in the skate unit employs a battery as a power source, either primary or secondary. It is also possible to use the calculated speed information to set a limit or top speed for the skater. In this case, when the limit has been reached, the brake signal could automatically be transmitted, without input from the skater to slow down.

While these preferred embodiments illustrate the invention, it is apparent that modifications of this invention may be practiced without departing from the scope of the invention. For example the batteries of both the hand held unit and on the skate could be recharged by plugging into an AC source. The generator could be selectively actuated as a function of terrain, for example engaged while running down-hill where the inherent friction would induce a degree of braking action itself. Further, the kinetic energy brake driver may take other formats all of which translate the skaters momentum into the force required to activate the brakes.

What is claimed is:

1. A braking system for a pair of roller skates, each roller skate including a plurality of rollers situated along a line of directional travel of the skate in at least one row of rollers, comprising; an actuatable brake mounted on at least one roller skate, a hand held radio unit including a receiver and a display, said radio unit having an actuator and a radio signal transmitter responsive to said actuator to output a brake initiation signal, a radio signal receiver positioned on at least one roller skate receiving said brake initiation signal and coupled to said brake; means to sense revolutions of a wheel on said skate, a transmitter located on said skate to produce a radio frequency signal indicative of wheel rotation to said hand held receiver, and said hand held receiver converting said signal indicative of wheel rotation into displayed data.

2. An electricity generating system for a pair of roller skates, each roller skate including a plurality of rollers along a line of directional travel of the skate in at least one row, comprising; a hand held transmitter and a receiver mounted on said skate, a braking device mounted on said skate and responsive to receiver, an electrical generating system responsive to rolling energy of a wheel to produce electricity, a skate battery which drives a braking system and, a regulator to provide a controlled voltage to charge said battery.

3. The braking system of 1 wherein the radio signal receiver includes a battery, and a switch which drives a braking system located on said skate.

4. The braking system of claim 1 further comprising a mechanical linkage coupling said radio signal receiver to said brake for applying frictional pressure to brake said skate.

5. The braking system of claim 1 wherein said hand-held radio signal transmitting device delivers an output signal modulated to signal an application of varying pressures by said brake.

6. An information system for a pair of roller skates, each roller skate including a plurality of rollers situated along a line of directional travel of the skate in at least one row, comprising; a sensor delivering an output signal indicative of wheel rotation, a skate mounted radio signal transmitter having as an input said wheel rotation signal and generating a radio signal output; a hand held unit including a radio signal receiver receiving said radio signal output, means for calculation of information derived from wheel rotation information, and a display of said information derived from wheel rotation.

7. The information system of claim 6, further comprising a rechargeable battery mounted on at least one skate and, means to recharge said battery based on wheel rotation.

8. The information system of claim 6, further comprising means on said skate to determine inclination of terrain traversed, said radio transmitter delivering a signal to said hand-held unit of inclination, said display providing a visual indication of the level of the terrain traversed.

9. The information system of claim 8, further comprising; a hand-held unit mounted radio signal transmitter having as an input calculated information, derived from wheel rotation and inclination of terrain information, on braking action required; a skate mounted radio signal receiver having as an input said braking action required and a braking device mounted on said skate which responds to said braking action required.

10. The information system of claim 8, further comprising a hand-held unit mounted noise, light, or vibration warning signal which beeps, flashes, or vibrates when said information or said calculated information becomes equal to a pre-set quantity.

* * * * *